US007678536B2

(12) United States Patent
Hatta

(10) Patent No.: US 7,678,536 B2
(45) Date of Patent: Mar. 16, 2010

(54) METHOD FOR MANUFACTURING LIQUID DISCHARGE HEAD, LIQUID DISCHARGE HEAD, AND LIQUID DISCHARGE RECORDING APPARATUS

(75) Inventor: Maki Hatta, Tachikawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 885 days.

(21) Appl. No.: 11/448,217

(22) Filed: Jun. 7, 2006

(65) Prior Publication Data

US 2006/0284933 A1 Dec. 21, 2006

(30) Foreign Application Priority Data

Jun. 17, 2005 (JP) ..... 2005-177965

(51) Int. Cl.
*B41J 2/16* (2006.01)

(52) U.S. Cl. ..... 430/320; 347/47

(58) Field of Classification Search ..... None
See application file for complete search history.

(56) References Cited

U.S. PATENT DOCUMENTS 5,331,344 A 7/1994 Miyagawa et al.
6,447,102 B1 9/2002 Chen et al.
6,520,627 B2 2/2003 Chen et al.
2004/0035823 A1 2/2004 Min et al.
2004/0070643 A1 4/2004 Kubota et al.

FOREIGN PATENT DOCUMENTS

JP 08-258275 10/1996
JP 10-119293 A * 5/1998
KR 2004-0019461 3/2004

OTHER PUBLICATIONS

Computer generated translation of JP 10-119293 (May 1998).*

* cited by examiner

*Primary Examiner*—John A. McPherson
(74) *Attorney, Agent, or Firm*—Canon USA Inc IP Div

(57) ABSTRACT

A method for manufacturing a liquid discharge head including an energy generating element for generating energy used to discharge a liquid, a discharge opening for discharging the liquid, and a channel for supplying the liquid to the discharge opening is provided. The method includes a step of forming a lamination on a substrate provided with the energy generating element, such that the lamination includes a plurality of laminated negative photosensitive resin layers with a light shielding film pattern for forming the channel, the light shielding film pattern being disposed therebetween, a step of exposing a portion which is set to be a member consisting the channel of the negative photosensitive resin layers in the lamination; and a step of removing an unexposed portion of the negative photosensitive resin layers in the lamination.

9 Claims, 7 Drawing Sheets

METHOD FOR MANUFACTURING LIQUID DISCHARGE HEAD, LIQUID DISCHARGE HEAD, AND LIQUID DISCHARGE RECORDING APPARATUS

BACKGROUND OF THE INVENTION

1. Field of the Invention

The present invention relates to a method for manufacturing a liquid discharge head that discharges a liquid, and more specifically, to a method for manufacturing an inkjet recording head.

2. Description of the Related Art

As a method that employs a liquid discharge head that discharges a liquid, an inkjet recording method is known.

An inkjet recording head adapted for use in the inkjet recording method typically has a fine recording liquid discharge opening, a liquid channel for allowing liquid to flow, and a liquid discharge energy generating element provided on a part of the liquid channel. Examples of previously known methods for manufacturing such an inkjet recording head are described below.

According to a manufacturing method disclosed in U.S. Pat. No. 5,331,344, an inkjet recording head is manufactured by forming a first photosensitive material layer in which an ink channel is to be formed, then performing a first pattern exposure for ink channel formation on the first photosensitive material layer by using a mask, then forming a second photosensitive material layer with a photosensitive spectrum region different from that of the first photosensitive material layer on the first photosensitive material layer, and then performing a second pattern exposure for discharge opening formation on the second photosensitive material layer with light having a different wavelength from light used in the first pattern exposure for ink channel formation.

According to another method disclosed in U.S. Pat. Nos. 6,447,102 and 6,520,627, an inkjet recording head is manufactured by laminating two materials with different sensitivities, the difference in sensitivity being realized by the action of a dye, and being irradiated with light with varied intensities.

More specifically, a negative resist lower layer having a slow cross-linking rate and a low sensitivity with the addition of a dye is formed on a substrate, and a negative resist upper layer having a high sensitivity without the addition of a dye is formed on the negative resist lower layer. Then, the negative resist upper and lower layers are subjected to a first pattern exposure for forming an ink channel wall, and the negative resist upper layer is subjected to a second pattern exposure for forming a discharge opening. Lastly, development is performed and an uncrosslinked portion is removed, thus forming the ink channel and discharge opening patterns.

In the former manufacturing method, however, since spin coating is used to form the second photosensitive material layer on the first photosensitive material layer, an unexposed portion of the first photosensitive material layer can be dissolved in a solvent in which the second photosensitive material dissolves.

Additionally, according to the latter manufacturing method, which is disclosed in U.S. Pat. Nos. 6,447,102 and 6,520,627, the difference in sensitivity to light between the upper and lower resists can be insufficient.

In either method, when development is performed by using a developer, the border between a soluble area and an insoluble area with respect to the developer can be unclear. Therefore, the development is susceptible to variations in concentration of the developer, and as a result, the thickness of an orifice plate in which a discharge opening is formed can vary widely. This prevents an inkjet recording head with a very fine ink channel from being manufactured with high yield.

SUMMARY OF THE INVENTION

The present invention is directed to a method for manufacturing an inkjet recording head having a very fine ink channel with high yield.

According to an aspect of the present invention, a method for manufacturing a liquid discharge head including an energy generating element configured to generate energy that facilitates discharging a liquid, a discharge opening adapted to discharge the liquid, and a channel supplying the liquid to the discharge opening is provided. The method includes a step of forming a lamination on a substrate provided with the energy generating element, such that the lamination includes a plurality of laminated negative photosensitive resin layers with a light shielding film pattern for forming the channel, the light shielding film pattern being disposed therebetween; a step of exposing a portion which is set to be a member consisting the channel of the negative photosensitive resin layers in the lamination using a discharge opening mask; and a step of removing an unexposed portion of the negative photosensitive resin layers in the lamination.

Further features of the present invention will become apparent from the following description of exemplary embodiments with reference to the attached drawings.

DESCRIPTION OF THE EMBODIMENTS

An exemplary embodiment is described below with reference to the drawings.

In the following explanation, an inkjet recording method is described as an application of the present invention, although the applicability of the present invention is not limited thereto.

An inkjet recording head to which the present invention is applicable and an inkjet cartridge that incorporates the inkjet recording head are described below.

Figure 6:
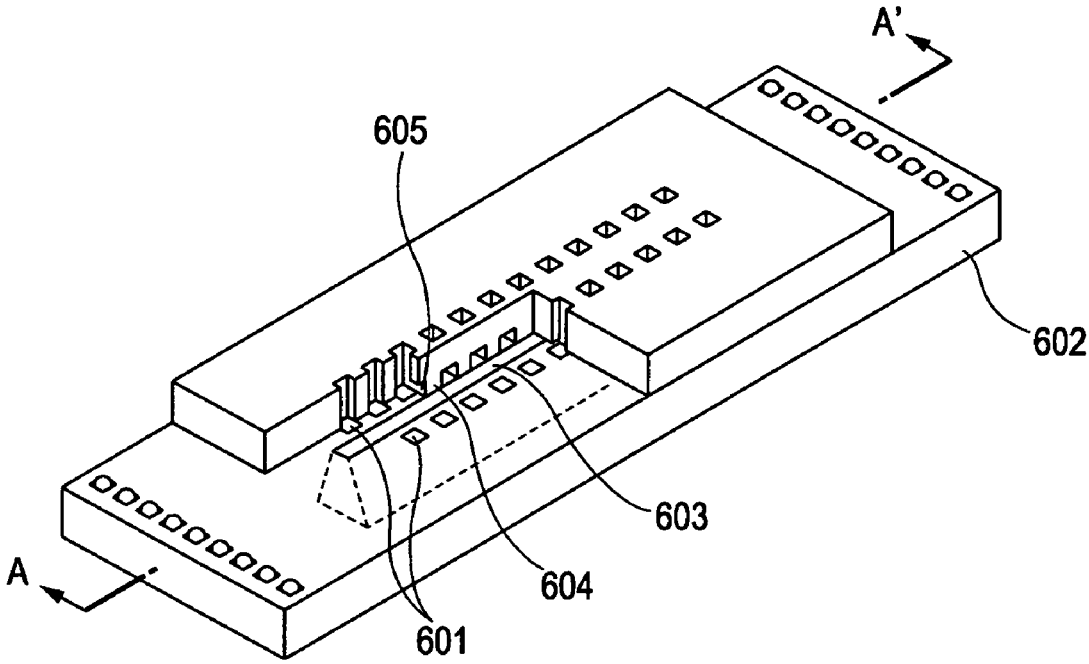
FIG. 6 is a perspective view of an inkjet recording head manufactured by a manufacturing method according to an exemplary embodiment.

FIG. 6 is a schematic perspective view of an inkjet recording head according to an exemplary embodiment.

The inkjet recording head in the exemplary embodiment includes a silicon substrate 602 provided with ink discharge pressure generating elements (ink discharge energy generating elements) 601 arranged in two rows at a predetermined pitch. The silicon substrate 602 includes an ink supply opening 603 disposed between the two rows of the ink discharge pressure generating elements 601. The ink supply opening 603 can be formed by anisotropic etching silicon. On the silicon substrate 602, discharge openings 605 which upwardly open and individually correspond to the ink discharge pressure generating elements 601 and individual ink channels communicating from the ink supply opening 603 to the discharge openings 605 are defined by an ink channel wall forming member 604.

The inkjet recording head is arranged such that a surface where the ink supply opening 603 is formed faces the recording surface of a recording medium. The inkjet recording head discharges ink droplets from the discharge openings 605 by applying pressure generated by the ink discharge pressure generating elements 601 to ink that is filled in the ink channels through the ink supply opening 603. Transferring the ink droplets to the recording medium performs recording.

The inkjet recording head can be incorporated in an apparatus, such as a printer, copier, facsimile machine, and a word processor having a printer unit, and an industrial recording apparatus combined with various kinds of processing devices.

Steps for manufacturing the ink channel in accordance with a method for manufacturing the inkjet recording head according to an exemplary embodiment is described with reference to FIGS. 1A to 1G. FIGS. 1A to 1G illustrate cross-sectional views taken along a line A-A' of FIG. 6.

Figure 1A:
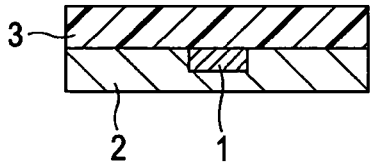
FIGS. 1A to 1G are schematic cross-sectional views of an inkjet recording head for illustrating fundamental steps of a method for manufacturing the inkjet recording head according to an exemplary embodiment and manufacturing steps according to Example 1 in chronological order.
Figure 1B:
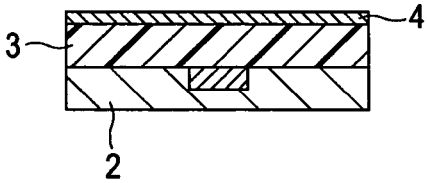

As shown in FIG. 1A, a first photosensitive material layer 3 is formed on a substrate 2 provided with a heating resistor (energy generating element) 1. Examples of the photosensitive material of the first photosensitive material layer 3 include an epoxy resin and polyimide resin. Subsequently, as shown in FIG. 1B, on the first photosensitive material layer 3, a light shielding film layer 4 is formed. As the material of the light shielding film layer 4, a photoresist that contains a metallic material (e.g., chromium, titanium, and/or nickel) and/or a dye can be used so as to block the irradiation energy. By reflecting and/or absorbing incident ultraviolet rays or X-rays, the light shielding film layer 4 blocks the energy of the rays. The light shielding film layer 4 has the capability of sufficiently blocking the irradiating light, and the film thickness thereof can be thinned. Therefore, patterning can be performed accurately.

Figure 1C:
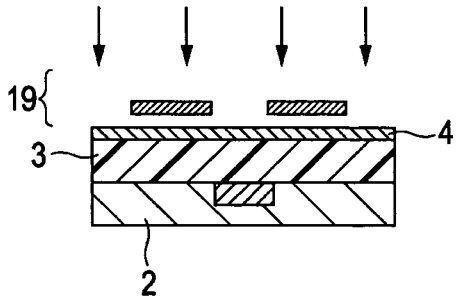
Figure 1D:
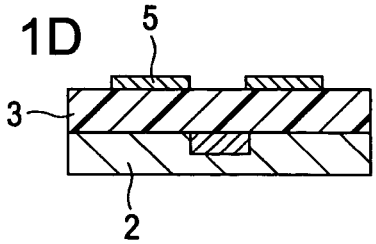

Subsequently, as shown in FIG. 1C, the light shielding film layer 4 is patterned by using a mask 19, and a light shielding film pattern 5 is formed (FIG. 1D).

In the case where the light shielding film layer 4 is formed from a metallic material, patterning can be performed through a dry etching process by using a resist having a high etching resistance as the mask. In the case of a photoresist to which a dye is added, patterning can be performed through a photolithography process. In the explanation here, a case in which a photoresist with an added dye is used is described.

Figure 1E:
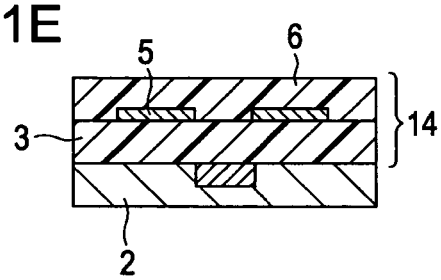

Additionally, as shown in FIG. 1E, on the light shielding film pattern 5, a negative photosensitive material layer 6 in which a nozzle wall is to be formed is formed.

The composition of the material of the negative photosensitive material layer 6, in which a nozzle wall is to be formed, may be the same as or different from that of the first photosensitive material layer 3, in which an ink channel is to be formed. Moreover, if necessary, materials having different characteristics can be used. More specifically, for example, one of the negative photosensitive material layer 6 and the first photosensitive material layer 3 has a higher sensitivity to light used in pattern exposure, whereas the other has a lower sensitivity thereto. An example method of changing the sensitivity between the layers is the addition of a dye.

Through the procedure described above, a lamination 14 of the laminated negative photosensitive resin layers with the light shielding film pattern disposed therebetween is formed on the substrate 2.

Figure 1F:
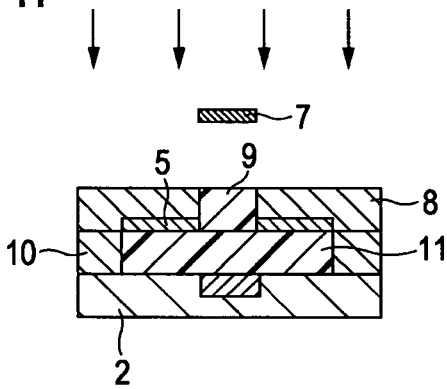

Subsequently, as shown in FIG. 1F, the lamination 14 is subjected to exposure using a photomask 7 having a discharge pattern, so that the negative photosensitive material layer 6, in which a nozzle wall is to be formed, has an exposed portion 8 and an unexposed portion 9. At this time, because the light shielding film pattern 5 blocks the irradiating light, a portion 10 on which no light shielding pattern is disposed is exposed in the first photosensitive material layer 3. In contrast, a portion 11 which is disposed directly below the light shielding film pattern 5 and the discharge opening mask 7 in the first photosensitive material layer 3 is unexposed.

Figure 1G:
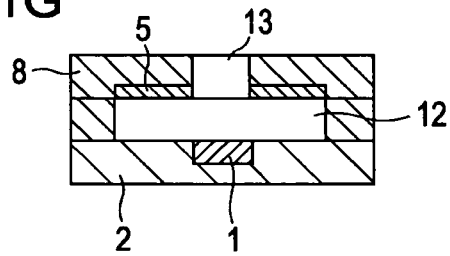

Subsequently, development is performed. The unexposed portions 9 and 11 shown in FIG. 1F are eluted, so that a discharge opening 13 and an ink channel 12 are formed and, as shown in FIG. 1G, the formation of a nozzle is completed.

the alignment of the light shielding film pattern 5 is accurate with respect to the discharge opening mask 7, the light shielding film pattern 5 may remain.

In the case where the light shielding film layer is a photoresist, it is possible to remove the light shielding film pattern 5 during development of the unexposed portions 9 and 11, depending on the kind of photoresist.

In the case where the light shielding film pattern is formed so as to extend to the lower portion of the discharge opening or where the light shielding film pattern is not open under the discharge opening to relax the requirements for alignment, if, as a result, an ink discharge is affected, the removal of the light shielding film is required. In this case, it can be removed with a dedicated remover, by dry etching, or the like.

According to the method for manufacturing the inkjet recording head according to an exemplary embodiment, the light shielding film pattern allows a cured portion in which a nozzle wall is to be formed and an unexposed portion to be removed to be clearly distinguished from each other, and therefore, the development is not substantially influenced by the variations in concentration of a developer.

Since the light shielding film layer is in close contact with the photosensitive material layer in which an ink channel wall is to be formed, the influence of diffraction in the direction of thickness of the film during the formation of an optical image is reduced. The rectangular features can be maintained, the accuracy of patterning can be improved, and the flexibility of the shape of a nozzle can be increased.

In the case where the light shielding film is formed from a negative photosensitive material, a negative photosensitive material from which an ink channel wall is to be formed can be unexposed to light having the wavelength used for exposure in forming the light shielding film pattern. In other words, the wavelength of light used for exposing the material of the light shielding film layer can be different from that of the layer in which the ink channel is to be formed. An exemplary example of a combination of materials is a combination of an epoxy resin exposed with far-ultraviolet rays as a negative photosensitive material from which an ink channel wall and a nozzle wall are to be formed and a quinone diazide photosensitive resin as a material of the light shielding film layer.

In this case, the epoxy resin has the sensitivity in the far ultraviolet region, whereas the quinone diazide photosensitive resin absorbs the far-ultraviolet rays and therefore the photosensitive resin functions as the light shielding film layer. Additionally, the quinone diazide resist can be patterned by exposure to g-line or i-line radiation, to which the epoxy resin is not sensitive. Therefore, a photosensitive material for forming an ink channel wall is prevented from being exposed during the formation of the light shielding film pattern.

In the case of an ink channel having two or more stages, laminating a negative photosensitive material layer in which an ink channel wall is to be formed and a light shielding film layer is merely repeated. Therefore, the complication in manufacturing steps resulting from the addition of a material does not occur. As a result, the discharge quality can be improved with a simple method.

Figure 7:
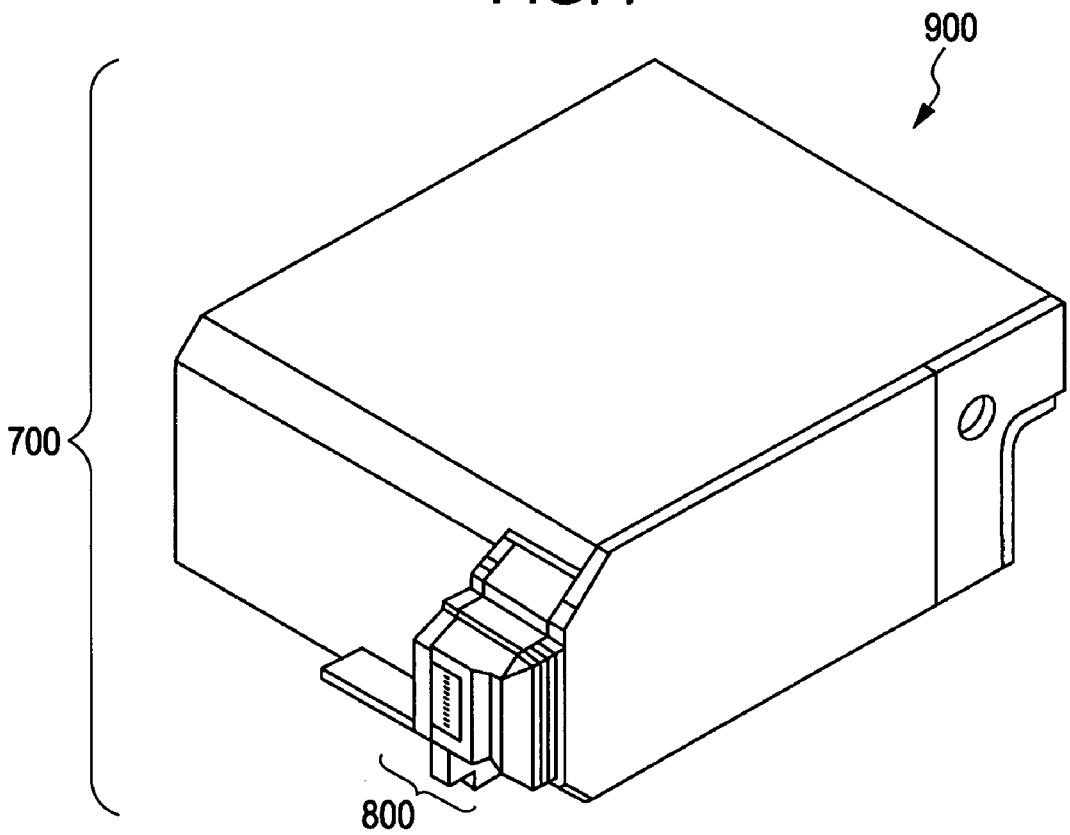
FIG. 7 illustrates an inkjet recording head cartridge incorporating an inkjet recording head manufactured by a manufacturing method according to an exemplary embodiment.

FIG. 7 illustrates a perspective view of a typical example of an inkjet cartridge incorporating the inkjet recording head shown in FIG. 6. An inkjet cartridge 700 includes an inkjet recording head 800 having the structure described above and an ink holding unit 900 holding ink to be supplied to the inkjet recording head 800 such that the inkjet recording head 800 is integrally formed with the ink holding unit 900. Alternatively, the inkjet recording head 800 and the ink holding unit 900 may be separately formed, and the ink holding unit 900 may be removable.

Figure 8:
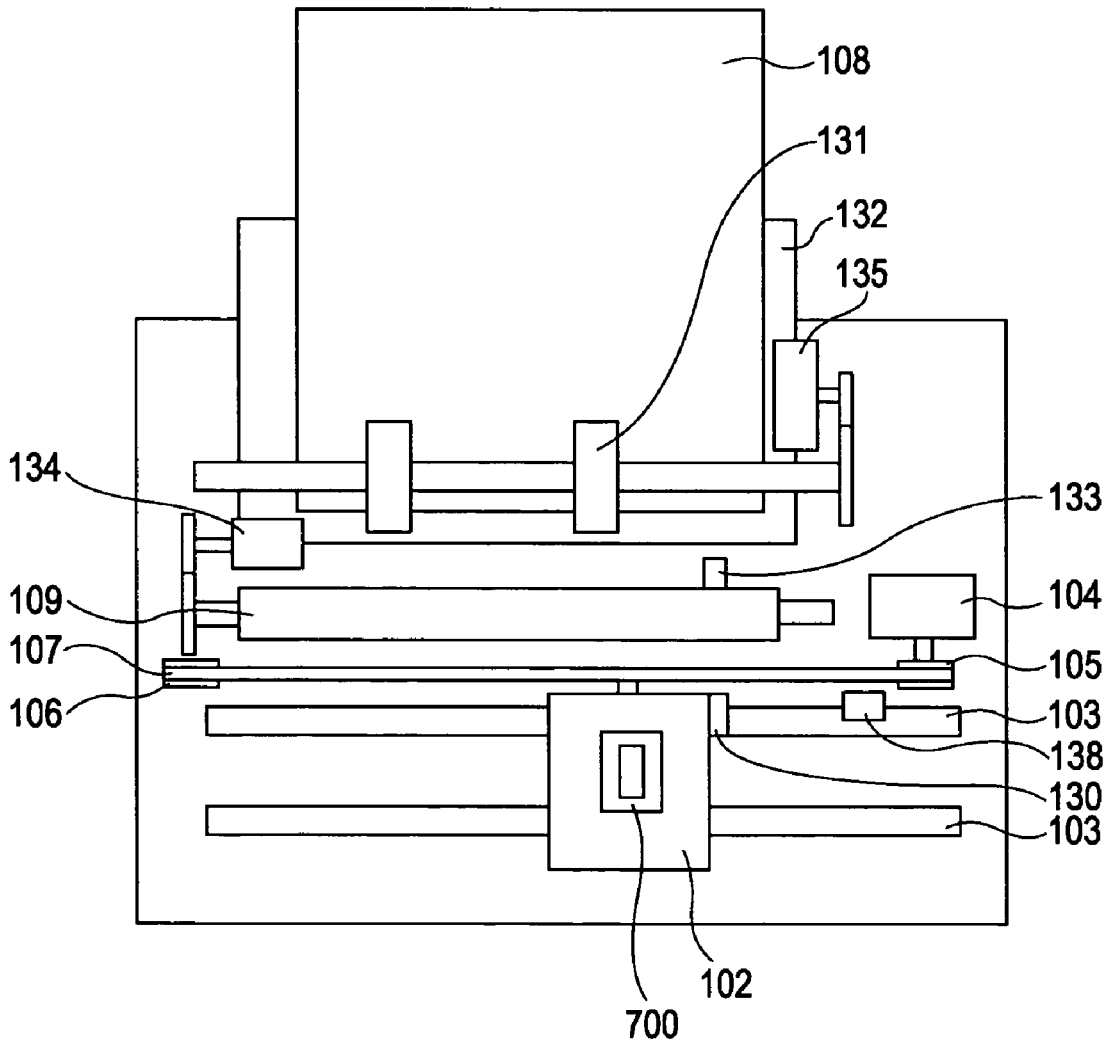
FIG. 8 illustrates a typical example of an inkjet recording apparatus that can incorporate an inkjet recording head.

A liquid discharge recording apparatus that can incorporate a cartridge-type recording head described above is described below. FIG. 8 illustrates a typical example of an inkjet recording apparatus that can incorporate a liquid discharge head according to an exemplary embodiment.

In the recording apparatus shown in FIG. 8, the inkjet cartridge 700 shown in FIG. 7 is mounted so as to be positioned at a carriage 102 and be replaceable. The carriage 102 is provided with an electrical connection unit for transmitting a driving signal and other signals to each discharge unit via an external-signal input terminal on the inkjet cartridge 700.

The carriage 102 is supported so as to be capable of being guided and reciprocating along guide shafts 103 which are mounted to the main body of the apparatus and which extend in the direction of main scanning. The carriage 102 is driven by a main scanning motor 104 through a driving mechanism including a motor pulley 105, a driven pulley 106, and a timing belt 107, and the position and movement of the carriage 102 is controlled thereby. The carriage 102 is provided with a home position sensor 130. Therefore, the position can be detected when the home position sensor 130 on the carriage 102 passes by a shielding plate 138.

A recording medium 108 (e.g., printing paper or a plastic thin plate) is separated from stacked recording media in an automatic sheet feeder (ASF) 132 by rotating a pickup roller 131 by a feeding motor 135 through a gear. Further, the recording medium 108 is moved through a position (print unit) that faces the discharge opening surface of the inkjet cartridge 700 and is conveyed (vertically scanned) by the rotation of conveying rollers 109. The rotation of the conveying rollers 109 is performed by an LF motor 134 through a gear. At this time, the determination whether the recording medium 108 has been fed and the determination of the position of the leading end thereof are performed when the recording medium 108 passes by a paper end sensor 133. The paper end sensor 133 is also used to locate the actual position of the trailing end of the recording medium 108 and to calculate the current recording position on the basis of the located actual position of the trailing end.

The back side of the recording medium 108 is supported by a platen (not shown) such that a printing surface of the recording medium 108 is even at the print unit. The inkjet cartridge 700 mounted on the carriage 102 is held such that the discharge opening surface of the inkjet cartridge 700 downwardly projects from the carriage 102 and is parallel to the recording medium 108 between the two sets of conveying rollers.

The inkjet cartridge 700 is mounted on the carriage 102 such that the discharge openings of the discharge units are aligned in a direction traverse to the direction of scanning of the carriage 102, and performs recording by discharging liquid from the rows of the discharge openings.

The present invention is further described below by referring to examples.

EXAMPLE 1

A first example is described with reference to FIGS. 1A to 1G.

The energy generating element 1 for generating energy to discharge an ink droplet and the silicon substrate 2 provided with a driver and logic circuit is first prepared.

Subsequently, a composite having the composition described below is applied on the silicon substrate 2 by spin coating such that the film thickness on the flat area is about 12 μm, and then the coated substrate is baked at about 100° C. for about 2 minutes (with a hot plate), so that the first photosensitive material layer 3 is formed (FIG. 1A).

| Composition 1 | |
|---|---|
| EHPE (Daicel Chemical Industries, Ltd.) | 100 pts. wt. |
| SP-170 (Asahi Denka Co., Ltd.) | 2 pts. wt. |
| A-187 (Nippon Unicar Co., Ltd.) | 5 pts. wt. |
| methyl isobutyl ketone | 100 pts. wt. |
| diglyme | 100 pts. wt. |

(The unit "pts. wt." represents parts by weight.)

Subsequently, an OFPR film (from Tokyo Ohka Kogyo Co., Ltd.) is applied on the substrate to be processed by spin coating such that the resulting film has a thickness of about 0.5 μm, and then the substrate is baked with a hot plate so that the light shielding film layer 4 is formed (FIG. 1B).

Subsequently, as shown in FIG. 1C, a pattern exposure to light having a wavelength of about 365 nm with an exposure dose of about 200 J/m$^2$ by using the mask 19 with FPA-3000iW (from Canon Kabushiki Kaisha) used as exposure equipment is performed. After the pattern exposure, development is performed, so that the light shielding film pattern 5 is formed (FIG. 1D).

Subsequently, the composition 1 is applied on the first photosensitive material layer 3 and the light shielding film pattern 5 by spin coating such that the film thickness on the flat area is about 10 μm. and then the coated substrate is baked at about 100° C. for about 2 minutes (with the hot plate), so that the second photosensitive material layer 6 is formed (FIG. 1E).

Subsequently, an exposure to light having a wavelength of about 248 nm with an exposure dose of about 500 J/m$^2$ by using the discharge mask 7 with FPA-3000OGMR (from Canon Kabushiki Kaisha) used as exposure equipment is performed (FIG. 1F). At this step, since the light shielding film pattern 5 formed from OFPR absorbs light with a wavelength of about 248 nm, the portion 11 which is disposed under the light shielding film pattern 5 in the first photosensitive material layer 3 and in which an ink channel is to be formed can be prevented from being exposed.

Subsequently, the lamination is baked at about 90° C. for about 3 minutes and then is subjected to development with methyl isobutyl ketone, so that the unexposed portion 11 and the unexposed portion 9 are fully removed. As a result, the discharge opening 13 and the ink channel 12 are formed (FIG. 1G). In this example, a discharge opening pattern of about ϕ10 μm is formed. Lastly, an opening pattern (not shown) for supplying ink is formed, an electrical bonding for driving the energy generating element (heating resistor) 1 is established, and the manufacture of the inkjet recording head is completed.

EXAMPLE 2

A second example of the present invention is described below with reference to FIGS. 2A to 2H. As the second example, a manufacturing method that removes a light shielding film in a step of forming a channel is explained.

In this example, since the light shielding film is removed ultimately, a light shielding film pattern can extend into a shielded area shielded by a discharge mask, i.e., an end face area adjacent to the channel in a portion where a discharge opening is to be formed. This permits the alignment of the light shielding film pattern and a discharge opening mask during the exposure for discharge opening patterning to be performed.

Figure 2A:
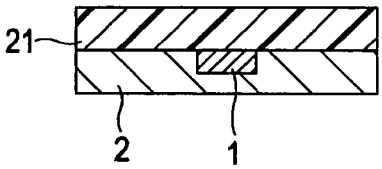
FIGS. 2A to 2H are schematic cross-sectional views of an inkjet recording head for illustrating manufacturing steps according to Embodiment 2.

First, as in Example 1, the composite 1 is applied on the substrate 2 by spin coating, so that a first photosensitive material layer 21 is formed (FIG. 2A).

Figure 2B:
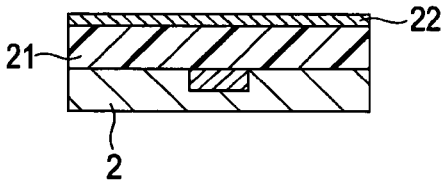

Subsequently, on the substrate to be processed, a metal film 22 containing chromium is formed as a light shielding film layer by sputtering (FIG. 2B).

Figure 2C:
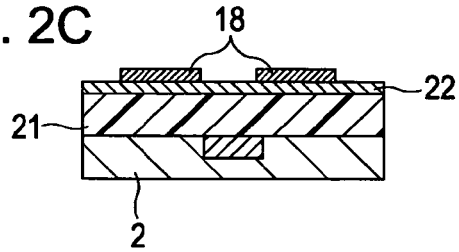
Figure 2D:
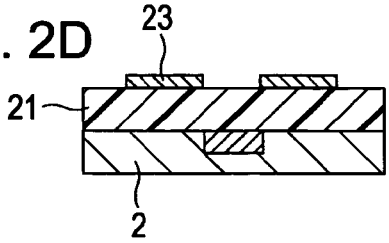

Subsequently, as shown in FIG. 2C, on the metal film layer 22, a resist pattern 18 is formed by photolithography. Then, a light shielding film pattern 23 is formed by dry etching (FIG. 2D).

Figure 2E:
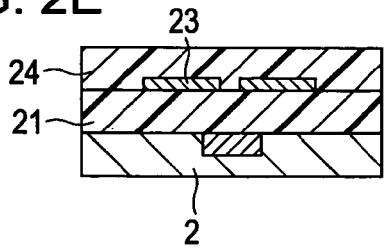

Subsequently, the composite 1 is applied on the metal film layer 22 and the light shielding film pattern 23 by spin coating, so that a second photosensitive material layer 24 is formed (FIG. 2E).

Figure 2F:
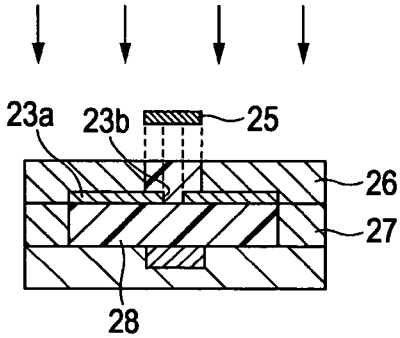

Subsequently, an exposure with an exposure dose of about 1000 mJ/cm$^2$ by using a discharge opening mask 25 with MPA-600 Super (from Canon Kabushiki Kaisha) is performed. At this point, for the light shielding film pattern 23, a portion 23*b* included in a projected area where the discharge opening mask 25 is projected with respect to the substrate and a portion 23*a* which is not included in the projected area are present (FIG. 2F). If the position of the discharge opening mask 25 is displaced, a portion 28 where the channel is to be formed is not exposed as long as the displacement falls within the portion 23*b*.

Figure 2G:
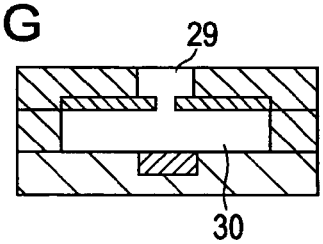

Subsequently, the lamination is baked with a hot plate and then subjected to development using methyl isobutyl ketone, so that an ink discharge opening 29 and an ink channel 30 are formed (FIG. 2G).

Figure 2H:
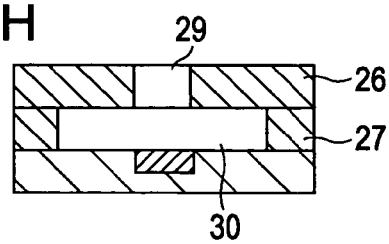

Subsequently, the light shielding film pattern 23 is removed by being immersed in a dedicated remover (FIG. 2H).

Lastly, the same final step as that in Example 1 is performed, so that the formation of the inkjet recording head is completed.

EXAMPLE 3

A third example of the present invention is described below with reference to FIGS. 3A to 3H. As the third example, a manufacturing method is explained that uses a light shielding film pattern in which an area corresponding to an end adjacent to a channel in a portion where a discharge opening is to be formed is not open.

In this example, a top layer in which an ink discharge opening is to be formed can be evenly laminated because an even light shielding film is formed all over a portion that corresponds to the bottom of the discharge opening.

Figure 3A:
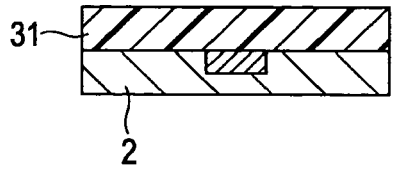
FIGS. 3A to 3H are schematic cross-sectional views of an inkjet recording head for illustrating manufacturing steps according to Embodiment 3.

First, as in Example 1, on the substrate 2, a first photosensitive material layer 31 is formed (FIG. 3A).

As the material of the first photosensitive material layer 31, SU8 (from IBM) can be used.

Figure 3B:
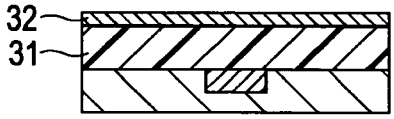

Subsequently, on the substrate to be processed, an OFPR film (from Tokyo Ohka Kogyo Co., Ltd.) is formed as a light shielding film layer 32 (FIG. 3B).

Figure 3C:
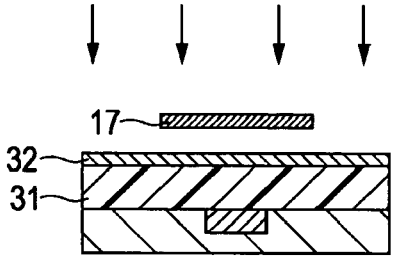
Figure 3D:
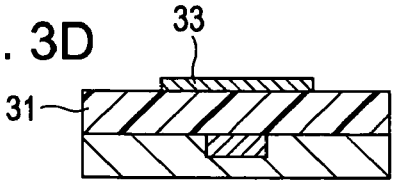

Subsequently, a light shielding film pattern 33 is formed through a photolithography step using a mask 17 with FPA-3000iW used as exposure equipment (FIGS. 3C and 3D). At this time, as the light shielding film pattern, a pattern in which an area corresponding to the bottom of the discharge opening is not open is used.

Figure 3E:
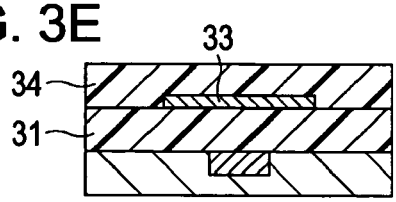

Subsequently, SU8 is applied on the first photosensitive material layer 31 and the light shielding film pattern 33 by spin coating, so that a second photosensitive material layer 34 is formed (FIG. 3E).

Figure 3F:
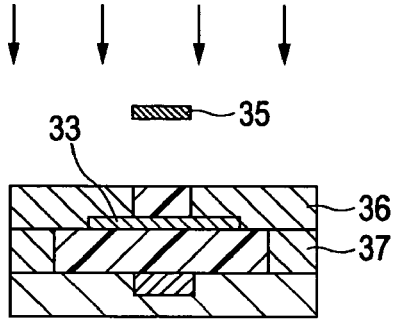
Figure 3G:
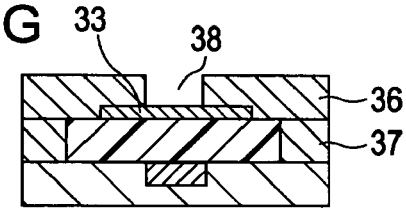

Subsequently, an exposure with an exposure dose of about 300 mJ/cm$^2$ by using a discharge opening mask 35 with FPA-3000GMR is performed (FIG. 3F). After the exposure, the lamination is baked with a hot plate and then subjected to development using SU8 developer, so that an unexposed portion where the nozzle wall is to be formed in the photosensitive material layer is removed, and thus an ink discharge opening 38 is formed (FIG. 3G).

Figure 3H:
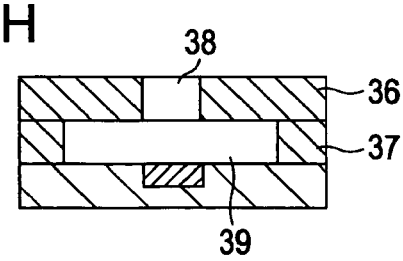

Subsequently, the light shielding film pattern 33 is removed with a dedicated remover, and then the unexposed portion where the ink channel wall is to be formed in the photosensitive material layer is removed, so that an ink channel 39 is formed (FIG. 3H).

Lastly, the same final step as that in Example 1 is performed, so that the formation of the inkjet recording head is completed.

EXAMPLE 4

A fourth example of the present invention is described below with reference to FIGS. 4A to 4E. As the fourth example, a method for manufacturing an inkjet recording head including an ink channel with two stages is explained. Applying this example allows an ink channel having a complex shape to be formed.

First, as in Example 1, the composite 1 is applied on the substrate 2 by spin coating, so that a first photosensitive material layer 41 is formed so as to have a thickness of about 12 μm.

Figure 4A:
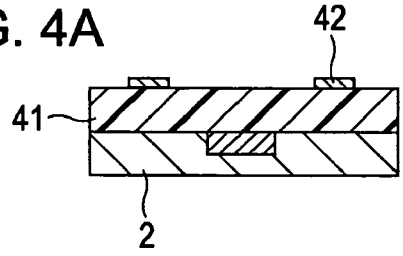
FIGS. 4A to 4E are schematic cross-sectional views of an inkjet recording head for illustrating manufacturing steps according to Embodiment 4.

Subsequently, on the substrate to be processed, a first light shielding film layer is formed through the same method as that in Example 1, and then a first light shielding film pattern 42 is formed by photolithography (FIG. 4A).

Figure 4B:
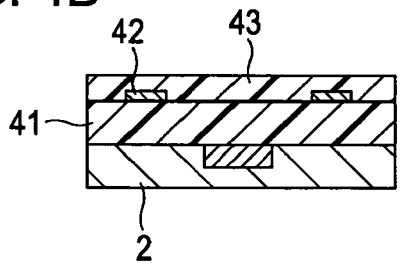

Subsequently, the composite 1 is applied on the first photosensitive material layer 41 and the first light shielding film pattern 42 by spin coating, so that a second photosensitive material layer 43 is formed to have a thickness of about 4 μm (FIG. 4B).

Subsequently, a second light shielding film layer is formed through the same method as that in Example 1, and then a second light shielding film pattern 45 is formed by patterning.

Figure 4C:
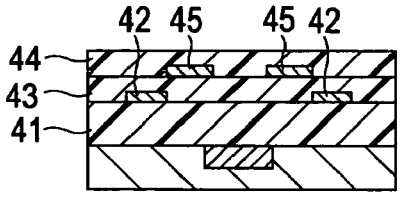

Subsequently, the composite 1 is applied on the lamination by spin coating, so that a third photosensitive material layer 44 is formed so as to have a thickness of about 6 μm (FIG. 4C).

Figure 4D:
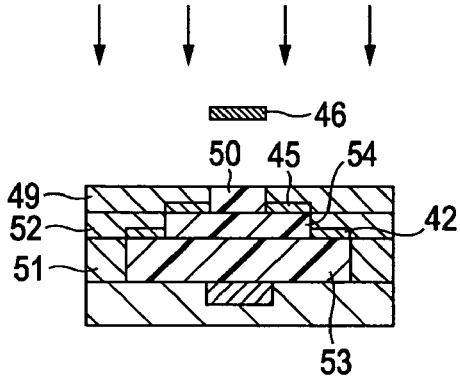
Figure 4E:
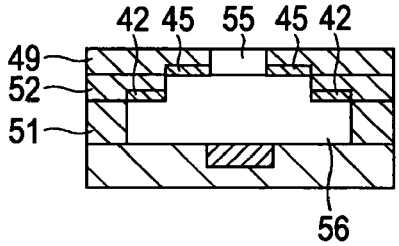

Subsequently, an exposure by using a discharge opening mask 46 with FPA-3000OGMR is performed (FIG. 4D). After the exposure, the lamination is baked with a hot plate and then subjected to development using methyl isobutyl ketone, so that an ink discharge opening 55 and an ink channel 56 are formed (FIG. 4E).

Lastly, the same final step as that in Example 1 is performed, so that the formation of the inkjet recording head is completed.

EXAMPLE 5

A fifth example of the present invention is described below with reference to FIGS. 5A to 5G. As the fifth example, a case in which a plurality of photosensitive material layers laminated on a substrate exhibit different characteristics is explained.

First, the following materials are prepared as photosensitive materials used in this example.

Photosensitive Material A: SU8 (from IBM)

Figure 5A:
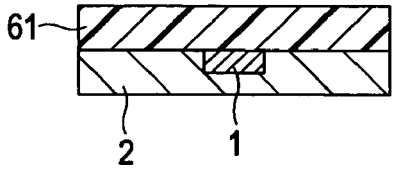
FIGS. 5A to 5G are schematic cross-sectional views of an inkjet recording head for illustrating manufacturing steps according to Embodiment 5.

Photosensitive Material B: a material that exhibits a lower sensitivity than that of the photosensitive material A by the addition of a dye to the photosensitive material A Subsequently, as in Example 1, on the substrate 2, a first photosensitive material layer 61 is formed of the photosensitive material A (FIG. 5A).

Figure 5B:
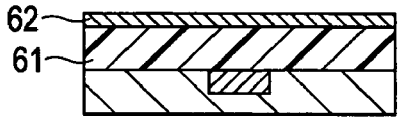

Subsequently, on the substrate to be processed, an OFPR film (from Tokyo Ohka Kogyo Co., Ltd.) is formed as a light shielding film layer 62 (FIG. 5B).

Figure 5C:
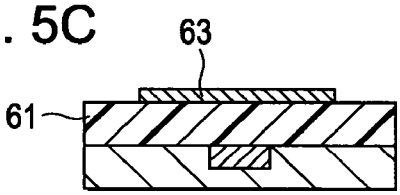

Subsequently, a light shielding film pattern 63 is formed through the same method as that in Example 3 (FIG. 5C).

Figure 5D:
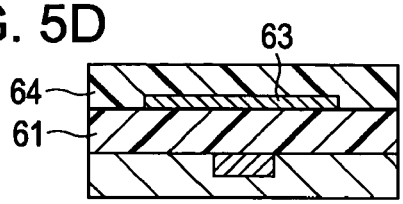

Subsequently, a second photosensitive material layer 64 is formed by applying the photosensitive material B on the first photosensitive material layer 61 and the light shielding film layer 62 by spin coating (FIG. 5D).

Figure 5E:
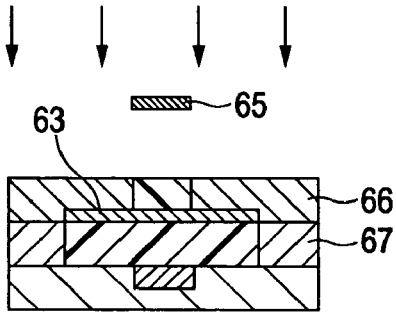
Figure 5F:
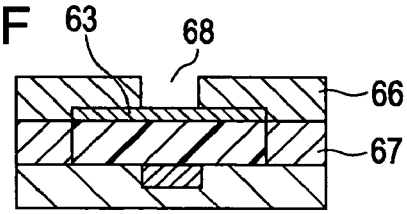

Subsequently, a pattern exposure with an exposure dose of about 300 mJ/cm$^2$ by using a mask 65 with FPA-3000iW (from Canon Kabushiki Kaisha) is performed, as shown in FIG. 5E. After the pattern exposure, the lamination is baked with a hot plate and then subjected to development using SU8 developer, so that an unexposed portion in the second photosensitive material layer is removed and an ink discharge opening 68 is formed (FIG. 5F).

Figure 5G:
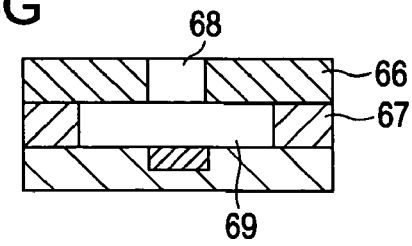

Subsequently, the light shielding film pattern 63 is removed with a dedicated remover. After the removal, an unexposed portion in the first photosensitive material layer is removed, so that an ink channel 69 is formed (FIG. 5G).

Lastly, the same final step as that in Example 1 is performed, so that the formation of the inkjet recording head is completed.

The evaluation of discharging and recording in a recording apparatus that incorporates the inkjet recording head manufactured by using the manufacturing method described above in each of Examples 1 to 5 shows the capability of performing a good image recording.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-177965 filed Jun. 17, 2005, which is hereby incorporated by reference herein in its entirety.

What is claimed is:

1. A method for manufacturing a liquid discharge head including an energy generating element configured to generate energy that facilitates discharging a liquid, a discharge opening adapted to discharge the liquid, and a channel supplying the liquid to the discharge opening, the method comprising the following steps:

a step of forming a lamination on a substrate provided with the energy generating element, such that the lamination includes a plurality of laminated negative photosensitive resin layers with a light shielding film pattern for forming the channel, the light shielding film pattern being disposed therebetween, wherein the step of forming the lamination on the substrate includes the steps of:

forming a first negative photosensitive resin layer on the substrate;

laminating a light shielding film forming material on the first negative photosensitive resin layer;

forming the light shielding film pattern by patterning the light shielding film forming material; and forming a second negative photosensitive resin layer on the first negative photosensitive resin layer and the light shielding film pattern;

a step of exposing a portion which is set to be a member consisting the channel of the negative photosensitive resin layers in the lamination using a discharge opening mask; and a step of removing an unexposed portion of the negative photosensitive resin layers in the lamination.

2. The method according to claim 1, wherein the plurality of negative photosensitive resin layers in the lamination includes at least three negative photosensitive resin layers.

3. The method according to claim 2, wherein the lamination includes a plurality of light shielding film patterns that are different from one another.

4. The method according to claim 1, wherein the plurality of negative photosensitive resin layers are formed of resin having the same composition.

5. The method according to claim 1, wherein the plurality of negative photosensitive resin layers are formed of epoxy resin containing an epoxy group.

6. The method according to claim 1, further comprising a step of removing the light shielding film pattern after the step of removing the unexposed portion of the negative photosensitive resin layers in the lamination.

7. The method according to claim 1, further comprising removing the light shielding film pattern simultaneously with the step of removing the unexposed portion of the negative photosensitive resin layers in the lamination.

8. The method according to claim 1, wherein the exposing step includes exposing so that the light shielding film pattern extends inside a light-shielded region produced by the discharge opening mask.

9. The method according to claim 1, wherein the discharge opening is formed in at least a top negative photosensitive resin layer relative to the substrate among the plurality of negative photosensitive resin layers.

* * * * *